US011421512B1

(12) United States Patent
Egbe et al.

(10) Patent No.: US 11,421,512 B1
(45) Date of Patent: Aug. 23, 2022

(54) REMOVING OBSTRUCTIONS IN A DRILL BIT

(71) Applicant: Saudi Arabian Oil Company, Dhahran (SA)

(72) Inventors: Peter Ido Egbe, Abqaiq (SA); Victor Jose Bustamante Rodriguez, Abqaiq (SA); Sajid Hussain, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/235,172

(22) Filed: Apr. 20, 2021

(51) Int. Cl.
*E21B 41/00* (2006.01)
*E21B 37/00* (2006.01)
*E21B 10/18* (2006.01)

(52) U.S. Cl.
CPC ..... *E21B 41/0078* (2013.01); *E21B 10/18* (2013.01); *E21B 37/00* (2013.01)

(58) Field of Classification Search
CPC ..... E21B 41/0078; E21B 10/18; E21B 37/00; E21B 37/04; E21B 41/005
See application file for complete search history.

(56) References Cited

U.S. PATENT DOCUMENTS 3,011,571 A 12/1961 De Bree et al.
4,072,166 A * 2/1978 Tiraspolsky ..... F16K 17/044 137/496
4,494,618 A 1/1985 Radtke
6,390,211 B1 * 5/2002 Tibbitts ..... E21B 10/61 175/393
10,323,464 B1 6/2019 Al-AbdulJabbar

FOREIGN PATENT DOCUMENTS

EP 0107630 A2 9/1983

* cited by examiner

*Primary Examiner* — Yong-Suk (Philip) Ro
(74) *Attorney, Agent, or Firm* — Fish & Richardson P.C.

(57) ABSTRACT

A wellbore assembly includes a drill string and a drill bit in fluid communication with the drill string. The drill bit has a tubular wall, an internal fluid channel, a tapered tube, and a spring. The fluid channel receives and flows the drilling fluid from the drill bit bore and out the drill bit. The fluid channel includes an inwardly projecting shoulder. The tapered tube is disposed inside the fluid channel. The tube has a rim and a wall extending from and converging away from the rim in a flow direction of the drilling fluid. The spring is disposed between the inwardly projecting shoulder and the rim. The tapered tube is movable under fluidic pressure in the flow direction to compress or extend the spring. The tube pushes an obstruction in the fluid channel out of the fluid channel upon movement of the tube.

18 Claims, 7 Drawing Sheets

REMOVING OBSTRUCTIONS IN A DRILL BIT

FIELD OF THE DISCLOSURE

This disclosure relates to wellbore equipment, in particular, to drill bits.

BACKGROUND OF THE DISCLOSURE

Drill bits are tools used with a drill string to remove material from the ground to form wellbores such as production wellbores. Drill strings can flow drilling fluid from a surface of the wellbore to the drill bit. A drill bit with a fluid path and a nozzle allows the drilling fluid to be injected at high speeds to aid the drilling process. Methods and equipment for improving the drilling process using drilling fluids are sought.

SUMMARY

Implementations of the present disclosure include a wellbore assembly that includes a drill string and a drill bit. The drill string is disposed within a wellbore. The drill string flows drilling fluid through a drill string bore of the drill string to a downhole end of the wellbore. The drill bit is in fluid communication with and is coupled to a downhole and of the drill string. The drill bit has a tubular wall, an internal fluid channel, a tapered tube, and a spring. The tubular wall defines a drill bit bore in fluid communication with the drill string bore. The internal fluid channel is in fluid communication with the drill bit bore. The fluid channel receives and flows the drilling fluid from the drill bit bore and out the drill bit. The fluid channel includes an inwardly projecting shoulder. The tapered tube is disposed inside the fluid channel. The tube has a rim and a wall extending from and converging away from the rim in a flow direction of the drilling fluid within the fluid channel. The spring is coupled to and is disposed between the inwardly projecting shoulder and the rim of the tapered tube. The tapered tube is movable under fluidic pressure in the flow direction to compress or extend the spring. The tube pushes an obstruction in the fluid channel out of the fluid channel upon movement of the tube.

In some implementations, the internal fluid channel defines a fluid pathway extending from a fluid inlet of the internal fluid channel, through the tapered tube, and to a fluid outlet of the internal fluid channel. In some implementations, the fluid pathway extends from a fluid inlet at the rim of the tapered tube to a fluid outlet of the tapered tube disposed opposite the rim. The fluid outlet of the tapered tube includes an internal diameter smaller than an internal diameter of the fluid inlet of the tapered tube. In some implementations, the wall of the tapered tube defines apertures. The fluid pathway of the fluid channel extends through the fluid outlet of the tapered tube and through the apertures toward the fluid outlet of the fluid channel. In some implementations, the rim includes an outer diameter substantially similar to an internal diameter of the internal fluid channel.

In some implementations, the internal fluid channel includes a nozzle disposed at the outlet of the fluid channel. The tube pushes the obstruction out the channel through the nozzle.

In some implementations, the tapered tube is rotatable about a central longitudinal axis of the internal fluid channel. The tapered tube moves along the internal fluid channel and rotates, under fluidic pressure of the drilling fluid, pushing the obstruction disposed downstream of the tapered tube. In some implementations, the tapered tube includes an impeller secured to the wall of the tapered tube such that rotation of the impeller causes rotation of the tapered tube.

In some implementations, the drill bit further includes a sleeve coupled to the rim of the tapered tube. The sleeve is disposed around an internal surface of the spring. The sleeve covers the spring from obstructions within the internal fluid channel.

In some implementations, the inwardly projecting shoulder is disposed downstream of the rim of the tapered tube. The internal fluid channel further includes a second inwardly projecting shoulder upstream of the inwardly projecting shoulder with the spring disposed between the two inwardly projecting shoulders. The two inwardly projecting shoulders constrain the rim of the tapered tube to movement between the two inwardly projecting shoulders.

Implementations of the present disclosure include a wellbore tool that includes an outer wall and a spring-loaded shoe. The outer wall is disposed within a wellbore and defines an internal fluid channel that flows fluid toward a downhole end of the wellbore. The spring-loaded shoe is disposed at least partially inside the internal fluid channel. The spring-loaded shoe moves under fluidic pressure toward an outlet of the internal fluid channel, pushing an obstruction in the internal fluid channel out of the internal fluid channel.

In some implementations, the wellbore tool includes a drill bit that is coupled to a downhole end of a drill string. The drill bit includes a bore in fluid communication with the drill string. The internal fluid channel is disposed downhole of and in fluid communication with the bore. The fluid channel receives and flows drilling fluid received from the bore and out the drill bit.

In some implementations, the spring-loaded shoe includes a coupling end and a wall extending away from the first end. The wall includes a surface extending in a direction non-parallel with respect to a central longitudinal axis of the internal fluid channel such that the surface resists a flow of a fluid flowing through the internal fluid channel. The fluid pushes the spring-loaded shoe under a change of fluidic pressure of the fluid. In some implementations, the internal fluid channel includes an inwardly projecting shoulder that prevents the coupling end of the spring-loaded shoe from moving past the inwardly projecting shoulder.

In some implementations, the wellbore tool further includes a spring coupled to and disposed between the inwardly projecting shoulder and the coupling end of the spring-loaded shoe. The spring-loaded shoe is movable under fluidic pressure in a flow direction of the fluid to compress or extend the spring. In some implementations, the wellbore tool further includes a sleeve coupled to the coupling end of the spring-loaded shoe and disposed about an internal surface of the spring. The sleeve covers the spring from obstructions within the internal fluid channel. In some implementations, the inwardly projecting shoulder is disposed downstream of the coupling end and the internal fluid channel further includes a second inwardly projecting shoulder upstream of the inwardly projecting shoulder with the spring disposed between the two inwardly projecting shoulders. The two inwardly projecting shoulders constrain the coupling end of the spring-loaded shoe to movement between the two inwardly projecting shoulders.

In some implementations, the internal fluid channel includes a nozzle disposed at a fluid outlet of the internal fluid channel. The spring-loaded shoe pushes the obstruction out the internal fluid channel through the nozzle.

In some implementations, the spring-loaded shoe is rotatable about a central longitudinal axis of the internal fluid channel. The spring-loaded shoe moves along the internal fluid channel and rotates, under fluidic pressure of a fluid, pushing the obstruction disposed downstream of the spring-loaded shoe.

Implementations of the present disclosure include a method of removing an obstruction in a drill bit. The method includes flowing, during a wellbore drilling operation, a drilling fluid through a drill string and out a drill bit of the drill string. The drill bit includes a tubular wall, an internal fluid channel, a shoe, and a spring. The tubular wall defines a bore in fluid communication with the drill string. The internal fluid channel is in fluid communication with the bore and configured to receive and flow the drilling fluid from the bore out the drill bit. The shoe is disposed inside the fluid channel and includes a rim. The spring including a first end coupled to a wall of the internal fluid channel and a second end opposite the first end. The second end is coupled to the rim of the shoe. The shoe is movable under fluidic pressure in the flow direction to compress or extend the spring. The shoe pushes an obstruction in the fluid channel out of the fluid channel upon movement of the shoe. The method also includes determining, based on a change in fluidic pressure of the drilling fluid within the drill string, that there is an obstruction in the internal fluid channel of the drill bit. The method also includes increasing a fluidic pressure of the drilling fluid upstream of the shoe, pushing the shoe under fluidic pressure and removing the obstruction from the internal fluid channel.

DETAILED DESCRIPTION OF THE DISCLOSURE

The present disclosure describes obstruction removal assembly used during a wellbore drilling operation. During drilling, obstructions such as rocks or debris can enter and clog the nozzles of the drill bit. The obstruction removal device of the present disclosure includes a spring-loaded shoe or tube that moves under fluidic pressure to push and remove an obstruction out of a fluid channel of a drill bit.

Particular implementations of the subject matter described in this specification can be implemented so as to realize one or more of the following advantages. For example, the drill bit can be unclogged or maintained without the need of pulling the drill bit out of the wellbore. Additionally, the drill bit can be unclogged without the need of deploying additional equipment or flowing solvents or other chemicals through the drill string.

Figure 1:
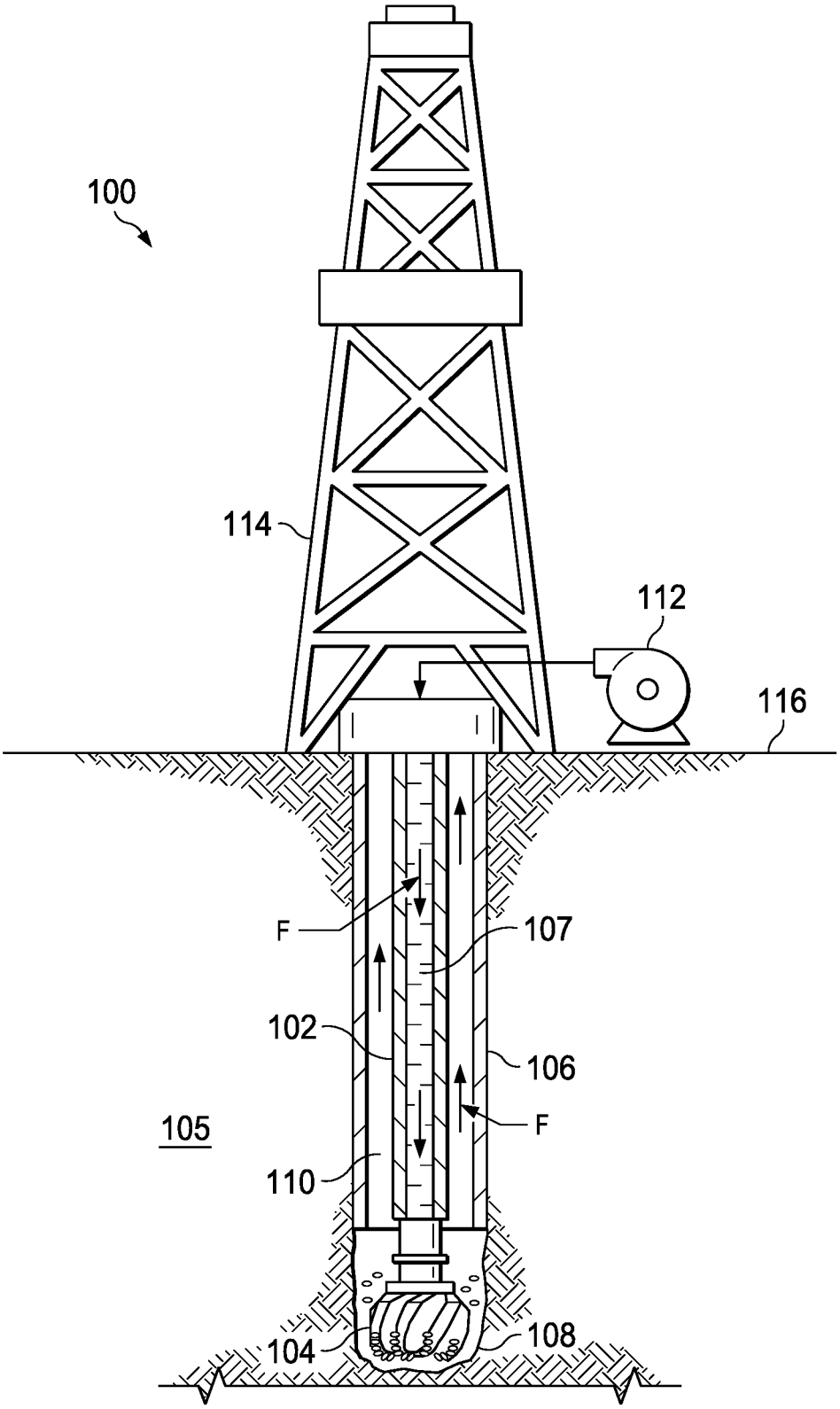
FIG. 1 is a front schematic view of a wellbore assembly according to implementations of the present disclosure.

FIG. 1 shows a wellbore assembly 100 implemented in a wellbore 106. The wellbore assembly 100 includes a wellbore string 102 (e.g., a drill string) disposed within the wellbore 120. The wellbore 120 extends from a ground surface 116 of the wellbore 120 to a downhole end 121 of the wellbore 120. The wellbore 120 is formed in a geologic formation 105 that can include a hydrocarbon reservoir from which hydrocarbons can be extracted. The wellbore assembly 100 can extend from a rig 114 or a different component at the surface 116 of the wellbore 100.

The drill string 102 can receive a drilling fluid 'F' from a fluid pump 112 residing at or near the surface 116 of the wellbore. The drill string 102 flows the drilling fluid 'F' through a bore 107 of the drill string 102 to a downhole end 108 of the wellbore 106. The wellbore assembly 100 also includes a drill bit 104 in fluid communication with and it is coupled to a downhole and of the drill string 102. For example, the drill bit 104 can be part of the drill string 106 and be coupled to a downhole end of the drill string tubing. The drilling fluid 'F' flows out of the drill string 102 through a nozzle of the drill bit 104 and flows up the wellbore 106 through an annulus 110 defined between the drill string 102 and the wellbore 106.

Figure 2:
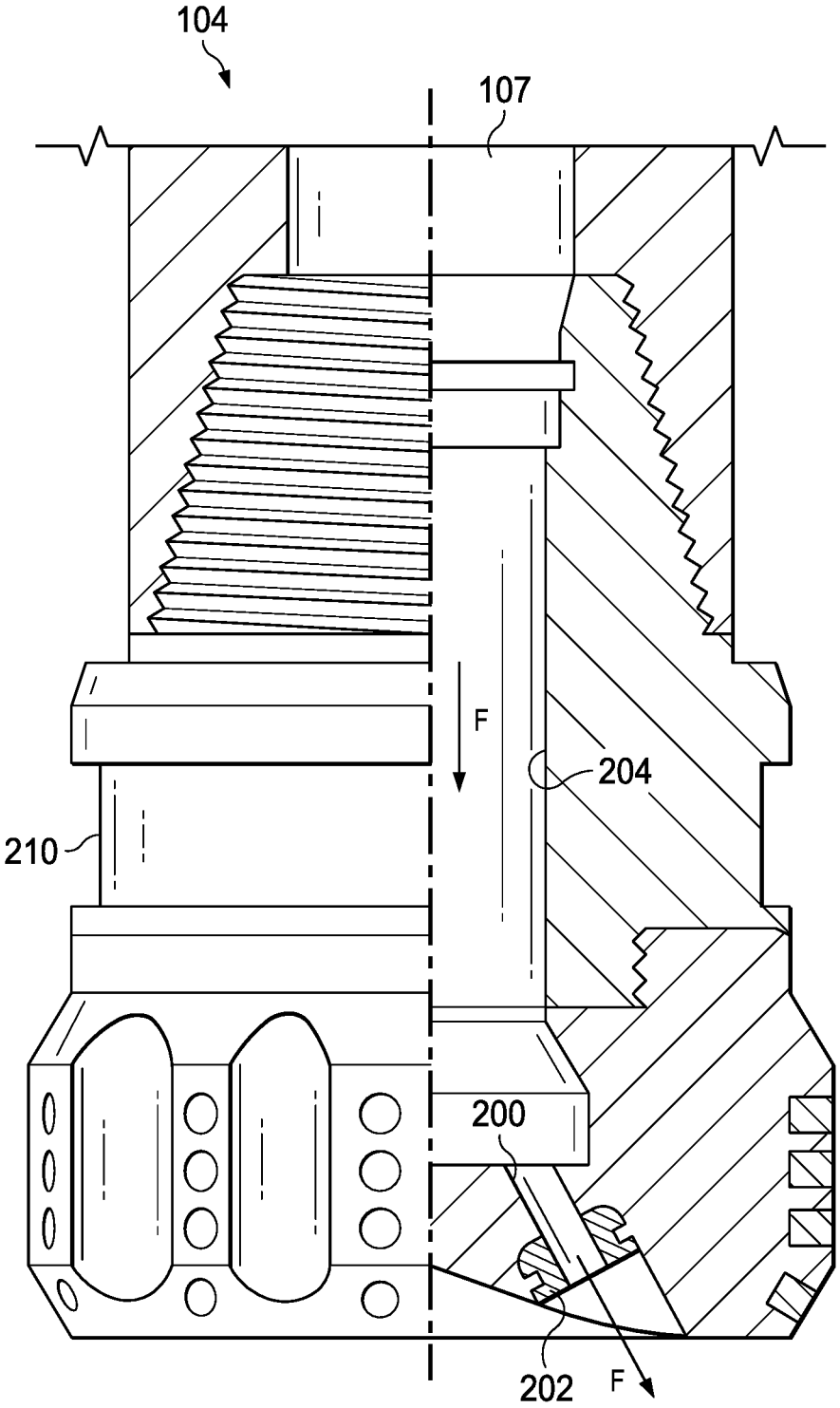
FIG. 2 is a front schematic view, partially cross sectional, of a drill bit according to implementations of the present disclosure.

Referring to FIG. 2, the drill bit 104 has a tubular or external wall 210 that defines an internal bore 204 in fluid communication with the drill string bore 107. The drill bit 104 also has an internal fluid channel 200 in fluid communication with the drill bit bore 204. The fluid channel 200 includes a nozzle 202 at the outlet of the channel 200. The fluid channel 200 receives and flows the drilling fluid 'F' from the drill bit bore 204 out through the nozzle 202 to exit the drill bit 104.

Figure 3:
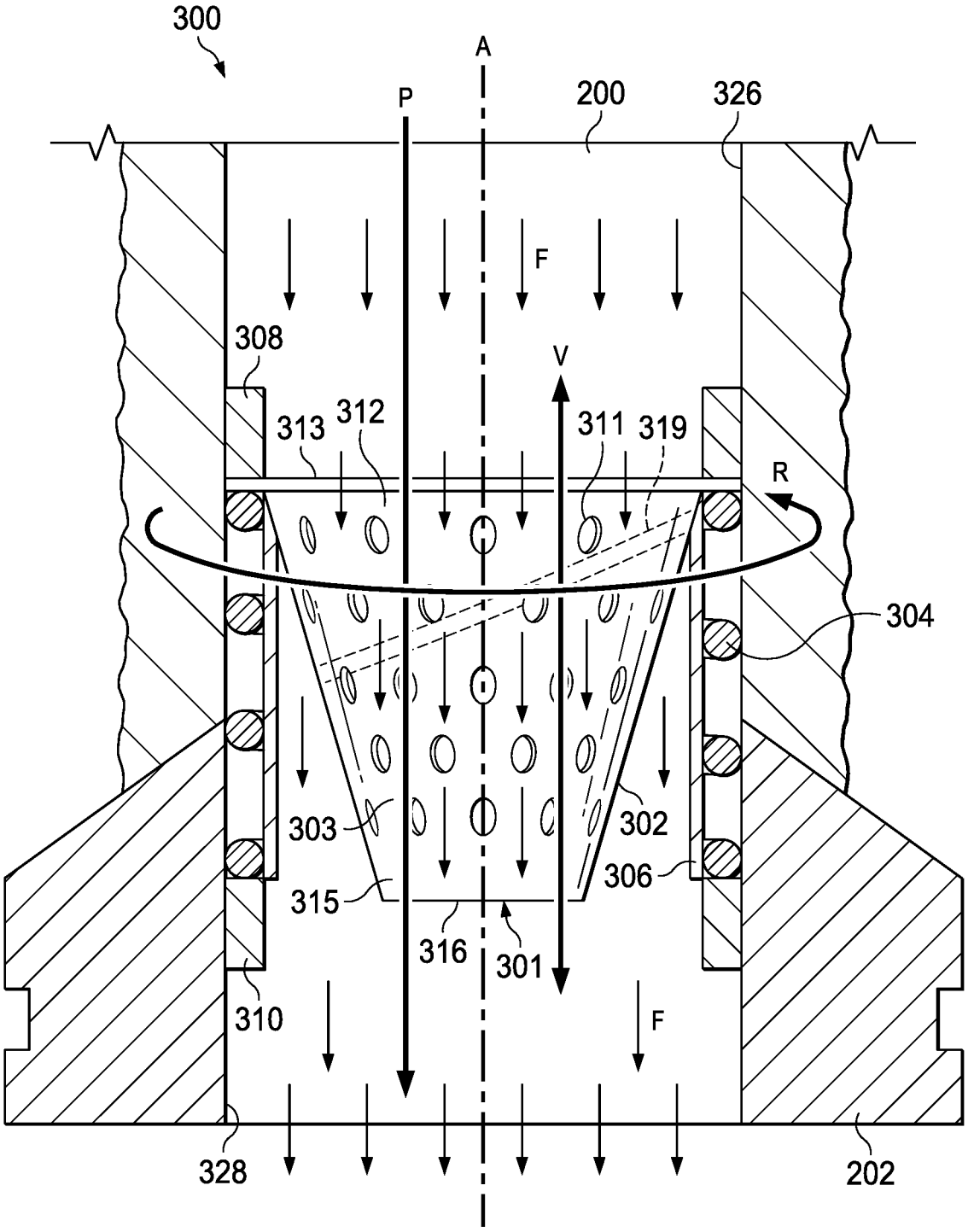
FIG. 3 is a front schematic view, cross sectional, of an internal fluid channel of a drill bit according to a first implementation of the present disclosure.

As depicted in FIG. 3, the fluid channel 200 has an obstruction removal assembly 300 that moves to push obstructions in the channel 200. The obstruction removal assembly 300 includes a first inwardly projecting shoulder 310, a second inwardly projecting shoulder 308, and a spring-loaded pushing device 301 (e.g., a tube, a funnel, a shoe, or a similar element). The shoulders 310 and 308 can be any type of stoppers or protruding members that constrain a rim 312 (or coupling end) of the pushing device 301 to movement between the shoulders 310 and 308. The first inwardly projecting shoulder 310 is disposed downstream of the rim 312 and the second inwardly projecting shoulder 308 is disposed upstream of the rim 312, with the spring disposed between the first shoulder 310 and the rim 312. The obstruction removal assembly 300 also includes a spring 304 that biases the rim 312 (and by extension the tube 302) toward the second inwardly projecting shoulder 308.

The pushing device 301 can be in the form of a tapered tube 302 or funnel that moves up and down along the fluid channel 200. The tube 302 has an upper rim 312 and a wall 303 that extends from the rim 312 toward the nozzle 202 to a lower rim 315. The upper rim 312 includes a wide opening or fluid inlet 313 through which the fluid 'F' enters the tube 302. The wall 303 converges away from the rim 312 in a flow direction of the drilling fluid 'F' within the fluid channel 200. The lower rim 315 includes a narrow fluid outlet 316 through which the fluid 'F' leaves the tube 302.

The tapered wall 303 of the tube 302 can have apertures 311 that allows the fluid 'F' to flow through the wall 303. For example, the fluid channel 200 defines a fluid pathway 'P' that extends from a fluid inlet 326 of the internal fluid channel 200, through the tapered tube 302, and to a fluid outlet 328 of the internal fluid channel 200. For example, the fluid pathway 'P' extends through the fluid inlet 313 of the tapered tube 302 to the fluid outlet 316 of the tapered tube 302. The fluid outlet 312 is disposed at an end opposite the rim 312 and has an internal diameter smaller than an internal diameter of the fluid inlet 313 of the tapered tube 302. The fluid pathway 'P' can also extend through the apertures 311 of the tube 302.

The spring 304 can include any biasing device that moves the tube 302. For example, the spring 304 can include one coil spring with an outer diameter slightly smaller than an internal diameter of the channel 200, or multiple small coil springs disposed about the channel 200. The rim 312 can have an outer diameter that is similar to or slightly smaller than the internal diameter of the channel 200. The spring engages the rim 312 to push the tube 302 against the second shoulder 308.

The assembly 300 can also include a sleeve 306 that covers and protects the spring 304 from obstruction (e.g., debris) that may enter the channel 200 during drilling. The sleeve 306 can be attached to the rim 312 of the tube 302 and disposed around an internal surface of the spring 304 to cover the spring 304 from rocks or debris that may enter the nozzle 202.

The tube 302 is movable under fluidic pressure of the fluid 'F' in the flow direction of the fluid 'F' to compress the spring 304 and push an obstruction out of the channel 200. The tube 302 can translate along a vertical direction 'V' parallel to a central longitudinal axis 'A' of the channel 200. The tube can also rotate about the central longitudinal axis 'A' in a direction 'R' which can be clockwise or counter-clockwise, and can be a full 360-degree rotation (or more), or a partial rotation. For example, when the fluidic pressure of the drilling fluid 'F' upstream of the tube 302 exceeds a pressure downstream of the tube 302 and a force of the spring 304, the tube 302 moves (with a translation and rotation movement) toward the fluid outlet 328 of the channel 200, compressing the spring 304. When the force of the spring 304 exceeds the pressure of the fluid 'F' upstream of the tube 302, the spring 304 pushes the tube 302 toward the fluid inlet 326 of the channel 200.

The tube 302 can be rotated by way of any mechanism that converts a linear force into rotational motion, such as a push-turn button mechanism (e.g., a cam and follower mechanism), a helix mechanism (e.g., an impeller) that rotates under fluidic pressure to rotate the tube 302, or a pin and groove mechanism. For example, as shown in FIG. 3, the internal fluid channel can have a circumferential groove 319 and the wall or rim 312 of the tube 302 can have a pin disposed within the groove. The pin follows the grove under fluidic pressure of the drilling fluid, rotating the tube 302. The rotation of the tube can break or loosen the obstruction. For example, the external surface of the tube can have undulations, be coarse, or have sharp objects (e.g., blades or spikes) that engage the obstruction to move and loosen the obstruction.

Figure 4:
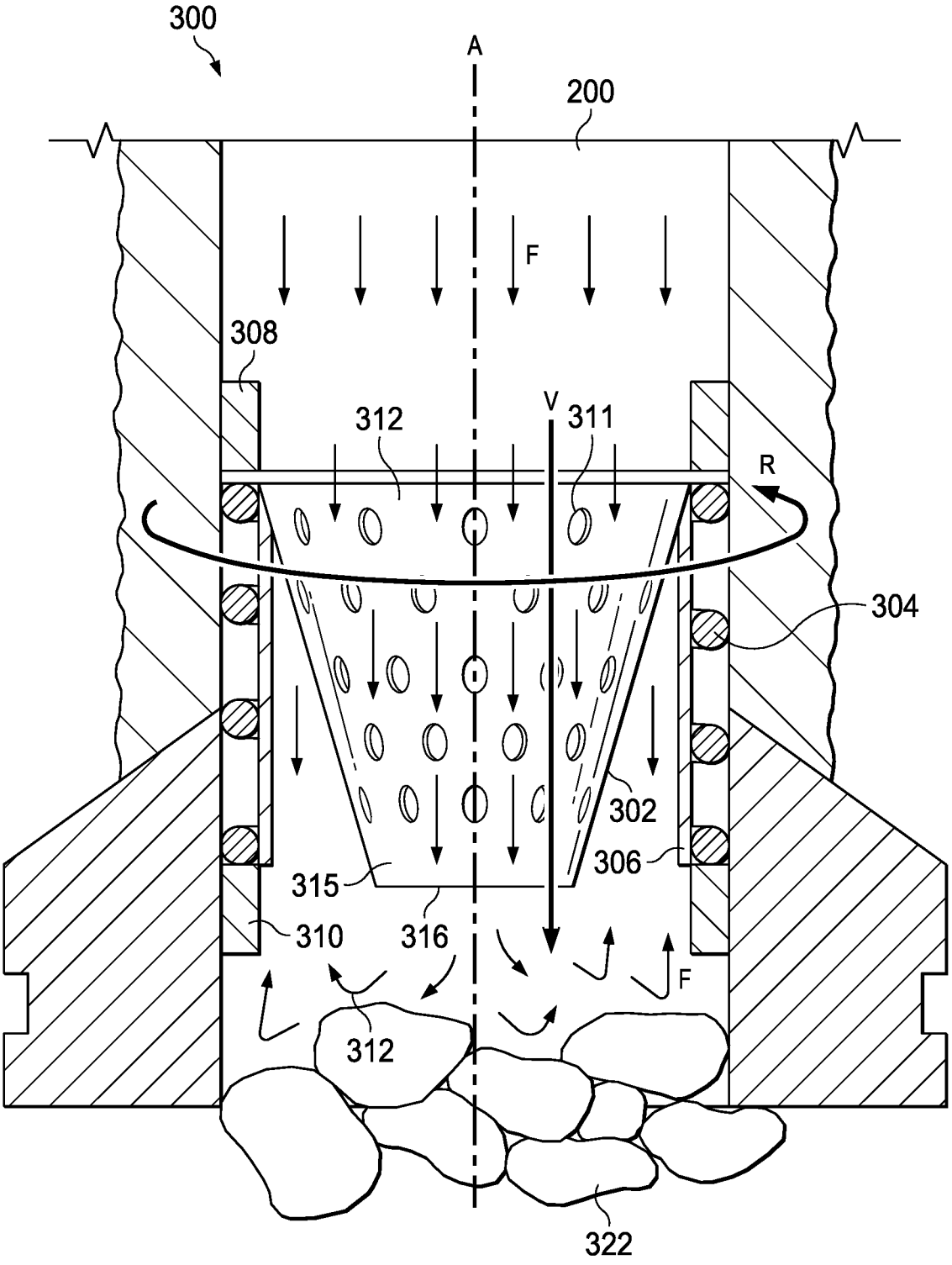
FIG. 4 is a front schematic view, cross sectional, of the internal fluid channel in FIG. 3, the internal fluid channel blocked by an obstruction.
Figure 5:
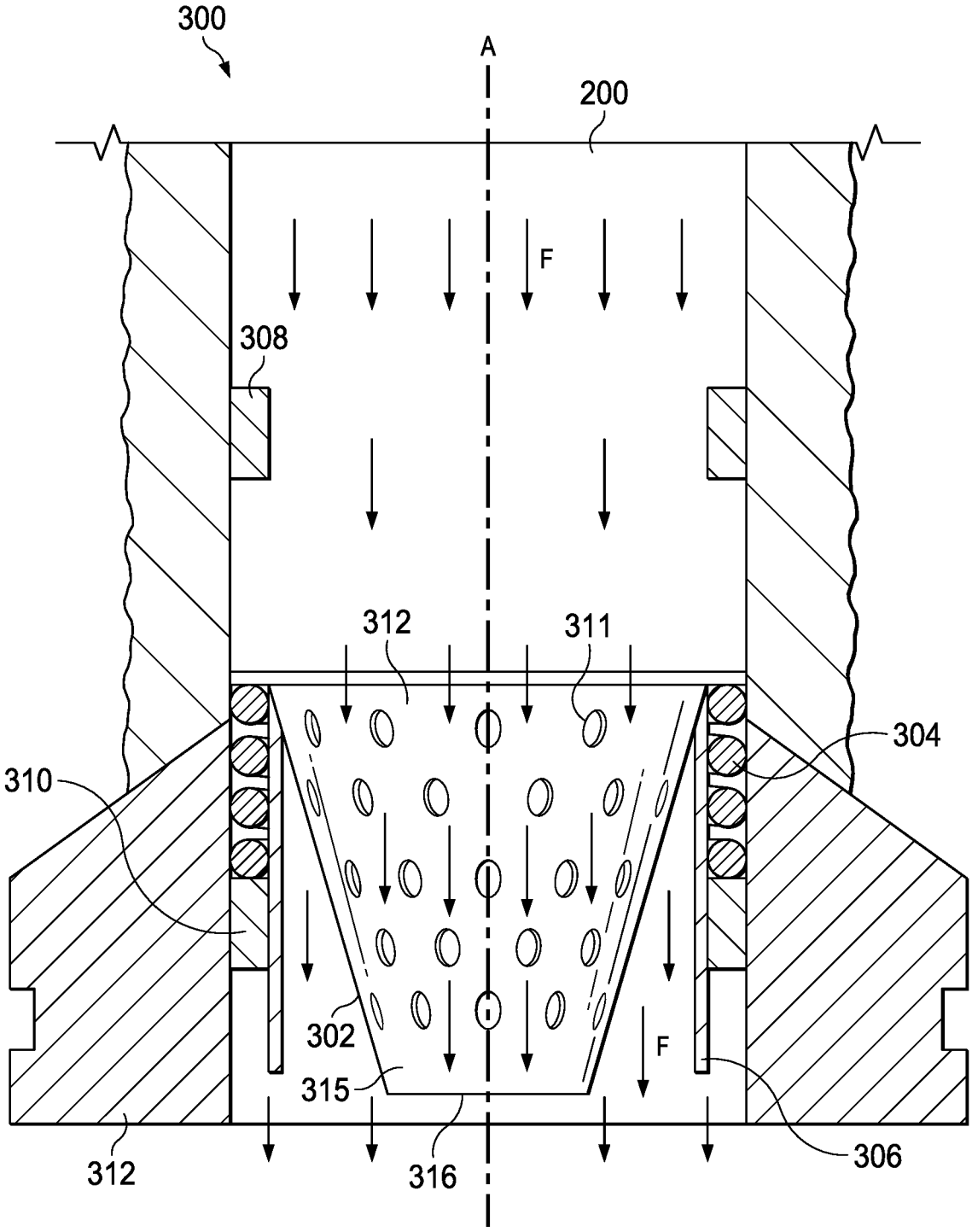
FIG. 5 is a front schematic view, cross sectional, of the internal fluid channel in FIG. 3, with the obstruction removed.

FIGS. 4 and 5 illustrate exemplary sequential steps of removing an obstruction 322 from the internal fluid channel 200. For example, during a drilling operation, after injecting drilling fluid through the nozzle for a period of time, an operator can determine, based on a change in fluidic pressure (e.g., an increase in pressure) of the drilling fluid 'F' within the drill string, that there is an obstruction 322 in the internal fluid channel 200 of the drill bit. The operator (or an automated system) can determine that the fluidic pressure satisfies a pressure threshold that can indicate that the channel 200 has an obstruction 322. After determining that there may be an obstruction in the channel 200, the fluidic pressure of the drilling fluid 'F' in the drilling string can be increased, pushing the tube 302 to remove the obstruction 322 from the internal fluid channel 200. As shown in FIG. 4, the increase in fluidic pressure pushes and rotates the tube 303 toward the obstruction. As shown in FIG. 5, the rotation and translation motion of the tube 303 moves and pushes the obstruction out of the fluid channel 200. The sleeve 306 moves with the rim 312 to continue to protect the spring 304.

Figure 6:
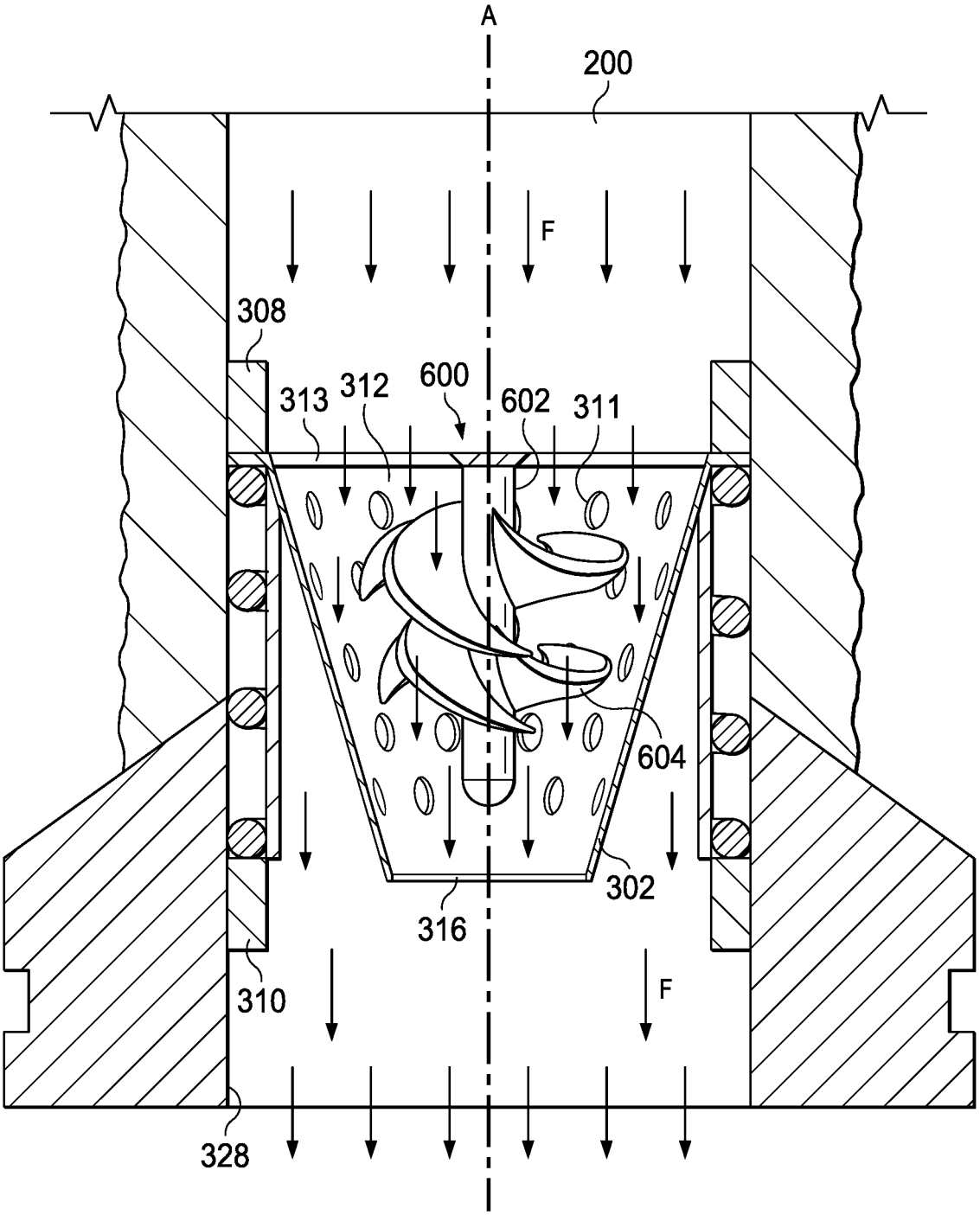
FIG. 6 is a front schematic view, cross sectional, of an internal fluid channel according to a second implementation of the present disclosure.

As shown in FIG. 6, the tapered tube can have an impeller 600 or another type of helix fixed to the wall of the tube 302 such that rotation of the impeller 600 causes rotation of the tube 302. The impeller 600 can be fixed to the rim 312 or the wall or another portion of the tube 302. The rim 312 can be detached from the spring such that the tube rotates freely with respect to the spring. The impeller 600 has a shaft 602 and blades 604. The shaft 602 can be attached to the rim 312 by a coupling arm.

Figure 7:
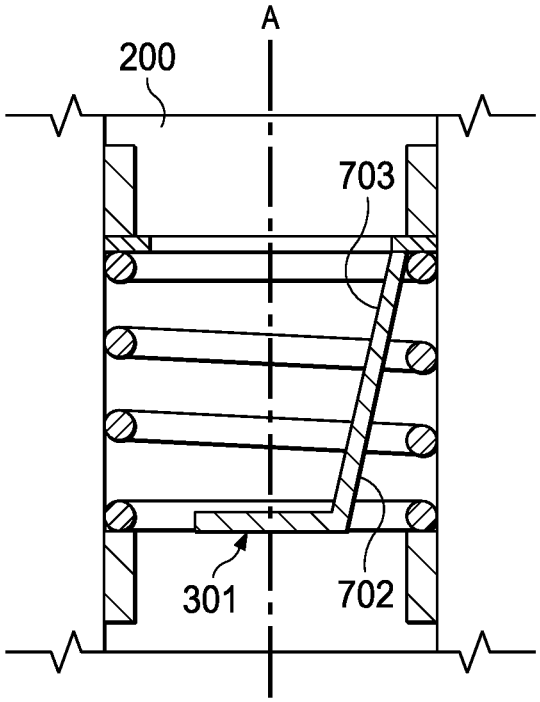
FIG. 7 is a front schematic view, cross sectional, of an internal fluid channel according to a third implementation of the present disclosure.

As shown in FIG. 7, the spring-loaded shoe 301 can have any shape that resists the flow of the drilling fluid. For example, the wall 702 of the shoe 301 can have an L-shape cross section. For instance, the wall 702 can have a surface 703 that extends in a direction non-parallel with respect to the central longitudinal axis 'A' of the internal fluid channel 200 such that the surface 703 resists a flow of the fluid flowing through the internal fluid channel such that the fluid pushes the spring-loaded shoe 301 under fluidic pressure of the fluid. The obstruction removal device 300 or wellbore tool of the present disclosure can be implemented in other parts of a wellbore string, such as in different nozzles of a drill string or in the internal bore of a wellbore string.

Figure 8:
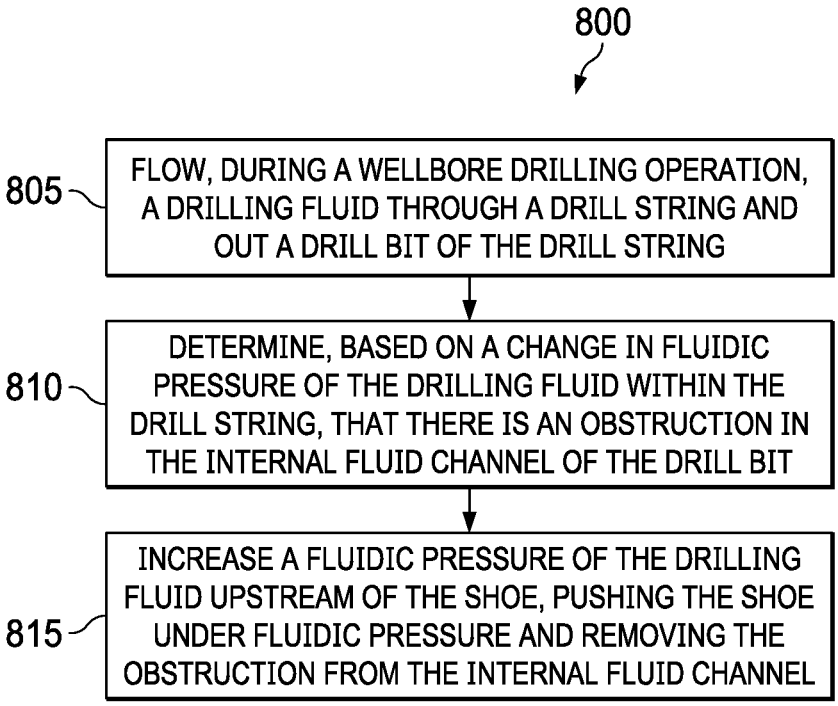
FIG. 8 is a flow chart of an example method of removing an obstruction in a drill bit.

FIG. 8 shows a flow chart of an example method 800 of removing an obstruction in a drill bit. The method includes flowing, during a wellbore drilling operation, a drilling fluid through a drill string and out a drill bit (e.g., the drill bit 104 of FIGS. 1-5) of the drill string (805). The method also includes determining, based on change in fluidic pressure of the drilling fluid within the drill string, that there is an obstruction in the internal fluid channel of the drill bit (810). The method also includes increasing a fluidic pressure of the drilling fluid upstream of the shoe, pushing the shoe under fluidic pressure and removing the obstruction from the internal fluid channel (815).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly comprising:

a drill string configured to be disposed within a wellbore, the drill string configured to flow drilling fluid through a drill string bore of the drill string to a downhole end of the wellbore; and a drill bit in fluid communication with and coupled to a downhole and of the drill string, the drill bit comprising, a tubular wall defining a drill bit bore in fluid communication with the drill string bore, an internal fluid channel in fluid communication with the drill bit bore, the fluid channel configured to receive and flow the drilling fluid from the drill bit bore and out the drill bit, the fluid channel comprising an inwardly projecting shoulder, a tapered tube disposed inside the fluid channel, the tube comprising a rim and a wall extending from and converging away from the rim in a flow direction of the drilling fluid within the fluid channel, and a spring coupled to and disposed between the inwardly projecting shoulder and the rim of the tapered tube, wherein the tube is movable under fluidic pressure in the flow direction to compress or extend the spring, the tube configured to push an obstruction in the fluid channel out of the fluid channel upon movement of the tube.

2. The wellbore assembly of claim 1, wherein the internal fluid channel defines a fluid pathway extending from a fluid inlet of the internal fluid channel, through the tapered tube, and to a fluid outlet of the internal fluid channel.

3. The wellbore assembly of claim 2, wherein the fluid pathway extends from a fluid inlet at the rim of the tapered tube to a fluid outlet of the tapered tube disposed opposite the rim, the fluid outlet of the tapered tube comprising an internal diameter smaller than an internal diameter of the fluid inlet of the tapered tube.

4. The wellbore assembly of claim 3, wherein the wall of the tapered tube defines apertures, the fluid pathway of the fluid channel extending through the fluid outlet of the tapered tube and through the apertures toward the fluid outlet of the fluid channel.

5. The wellbore assembly of claim 3, wherein the rim comprises an outer diameter substantially similar to an internal diameter of the internal fluid channel.

6. The wellbore assembly of claim 2, wherein the internal fluid channel comprises a nozzle disposed at the outlet of the fluid channel, the tube configured to push the obstruction out the channel through the nozzle.

7. The wellbore assembly of claim 1, wherein the tapered tube is rotatable about a central longitudinal axis of the internal fluid channel, the tapered tube configured to move along the internal fluid channel and rotate, under fluidic pressure of the drilling fluid, pushing the obstruction disposed downstream of the tapered tube.

8. The wellbore assembly of claim 7, wherein the tapered tube comprises an impeller secured to the wall of the tapered tube such that rotation of the impeller causes rotation of the tapered tube.

9. The wellbore assembly of claim 1, wherein the drill bit further comprises a sleeve coupled to the rim of the tapered tube and disposed around an internal surface of the spring, the sleeve configured to cover the spring from obstructions within the internal fluid channel.

10. The wellbore assembly of claim 1, wherein the inwardly projecting shoulder is disposed downstream of the rim of the tapered tube and the internal fluid channel further comprises a second inwardly projecting shoulder upstream of the inwardly projecting shoulder with the spring disposed between the two inwardly projecting shoulders, the two inwardly projecting shoulders configured to constrain the rim of the tapered tube to movement between the two inwardly projecting shoulders.

11. A drill bit comprising:

an outer wall configured to be coupled to a downhole end of a drill string and disposed within a wellbore, the outer wall defining an internal fluid channel configured to direct fluid out of the drill bit toward a downhole end of the wellbore, the drill bit comprising a bore in fluid communication with the drill string, the internal fluid channel disposed downhole of and in fluid communication with the bore, the fluid channel configured to receive the drilling fluid from the bore and direct the drilling fluid out the drill bit, wherein the internal fluid channel comprises a nozzle disposed at a fluid outlet of the internal fluid channel; and a spring-loaded shoe disposed at least partially inside the internal fluid channel, the spring-loaded shoe configured to move under fluidic pressure toward an outlet of the internal fluid channel, pushing, with an end of the shoe, an obstruction in the internal fluid channel out of the internal fluid channel, wherein the spring-loaded shoe is configured to push the obstruction out of the internal fluid channel through the nozzle.

12. The wellbore tool of claim 11, wherein the spring-loaded shoe comprises a coupling end and a wall extending away from the first end, the wall comprising a surface extending in a direction non-parallel with respect to a central longitudinal axis of the internal fluid channel such that the surface resists a flow of a fluid flowing through the internal fluid channel such that the fluid pushes the spring-loaded shoe under a change of fluidic pressure of the fluid.

13. The wellbore tool of claim 12, wherein the internal fluid channel comprises an inwardly projecting shoulder configured to prevent the coupling end of the spring-loaded shoe from moving past the inwardly projecting shoulder.

14. The wellbore tool of claim 12, further comprising a spring coupled to and disposed between the inwardly projecting shoulder and the coupling end of the spring-loaded shoe, the spring-loaded shoe movable under fluidic pressure in a flow direction of the fluid to compress or extend the spring.

15. The wellbore tool of claim 14, further comprising a sleeve coupled to the coupling end of the spring-loaded shoe and disposed about an internal surface of the spring, the sleeve configured to cover the spring from obstructions within the internal fluid channel.

16. The wellbore tool of claim 15, wherein the inwardly projecting shoulder is disposed downstream of the coupling end and the internal fluid channel further comprises a second inwardly projecting shoulder upstream of the inwardly projecting shoulder with the spring disposed between the two inwardly projecting shoulders, the two inwardly projecting shoulders configured to constrain the coupling end of the spring-loaded shoe to movement between the two inwardly projecting shoulders.

17. The wellbore tool of claim 11, wherein the spring-loaded shoe is rotatable about a central longitudinal axis of the internal fluid channel, the spring-loaded shoe configured to move along the internal fluid channel and rotate, under fluidic pressure of a fluid, pushing the obstruction disposed downstream of the spring-loaded shoe.

18. A method of removing an obstruction in a drill bit, the method comprising:

flowing, during a wellbore drilling operation, a drilling fluid through a drill string and out a drill bit of the drill string, the drill bit comprising:

a tubular wall defining a bore in fluid communication with the drill string, an internal fluid channel in fluid communication with the bore, the fluid channel configured to receive and flow the drilling fluid from the bore out the drill bit, wherein the internal fluid channel comprises a nozzle disposed at a fluid outlet of the internal fluid channel, a shoe disposed inside the fluid channel and comprising a rim, and a spring comprising a first end coupled to a wall of the internal fluid channel and a second end opposite the first end, the second end coupled to the rim of the shoe, wherein the shoe is movable under fluidic pressure in the flow direction to compress or extend the spring, the shoe configured to push, with an end of the shoe, an obstruction in the fluid channel out of the fluid channel and out the nozzle;

determining, based on a change in fluidic pressure of the drilling fluid within the drill string, that there is an obstruction in the internal fluid channel of the drill bit; and increasing a fluidic pressure of the drilling fluid upstream of the shoe, pushing the shoe under fluidic pressure and thereby pushing, with the end of shoe, the obstruction, removing the obstruction from the internal fluid channel.

* * * * *